US005666690A

United States Patent [19]

Domansky

[11] Patent Number: 5,666,690

[45] Date of Patent: Sep. 16, 1997

[54] CONDENSATION LINE PURGING DEVICE

[76] Inventor: Steven H. Domansky, 2915 Valley Ct., Loganville, Ga. 30249

[21] Appl. No.: 512,557

[22] Filed: Aug. 8, 1995

[51] Int. Cl.[6] ..... E03D 9/00

[52] U.S. Cl. ..... 15/406; 239/112

[58] Field of Search ..... 15/406; 239/104, 239/106, 112

[56] References Cited

U.S. PATENT DOCUMENTS

| | | | |
|---|---|---|---|
| 2,300,319 | 10/1942 | Smith . | |
| 2,564,402 | 8/1951 | MacArthur . | |
| 2,939,154 | 6/1960 | Gasser . | |
| 2,999,264 | 9/1961 | Stearns . | |
| 3,138,803 | 6/1964 | Caplan et al. . | |
| 3,156,584 | 11/1964 | Yurdin . | |
| 3,189,934 | 6/1965 | Steinwedel . | |
| 3,280,419 | 10/1966 | Frohlich . | |
| 3,315,280 | 4/1967 | Krenn . | |
| 3,426,774 | 2/1969 | Conn . | |
| 3,789,861 | 2/1974 | Conn et al. . | |
| 3,823,427 | 7/1974 | Pittet . | |
| 3,879,771 | 4/1975 | Nakane | 15/406 X |
| 4,059,858 | 11/1977 | Lambel et al. . | |
| 4,063,317 | 12/1977 | Santore | 15/406 X |
| 4,169,483 | 10/1979 | Bonn . | |
| 4,169,486 | 10/1979 | Otteman et al. | 15/406 X |
| 5,085,244 | 2/1992 | Funk . | |
| 5,127,129 | 7/1992 | Frank et al. | 15/406 |
| 5,249,311 | 10/1993 | Rau . | |
| 5,530,988 | 7/1996 | McQuillan | 15/406 |

*Primary Examiner*—Chris K. Moore

*Attorney, Agent, or Firm*—James L. Ewing, IV; Kilpatrick Stockton LLP

[57] ABSTRACT

Condensation line purging devices and assemblies. The present invention relates to devices and assemblies for purging HVAC condensation lines. Such lines are relatively delicate, as opposed, for instance, to drain lines and plumbing systems. Accordingly, devices of the present invention include a body which is adapted to contain a conventional gas cylinder such as a 12 gram $CO_2$ cylinder. The body is adapted to connect to a nozzle which in turn is connected to a connector that is attached to the condensation line. The body may be rotated onto the nozzle in a manner that controllably releases gas pressure from the gas cylinder into the condensation line so as to cause a pressure buildup that effectively purges the condensation line without breaching its seals or other discontinuities. Such control may occur by virtue of the shape of a pin protruding from the interior portion of the nozzle and adapted to penetrate the gas cylinder. It may occur by virtue of the shape of the pin in cooperation with the gas cylinder and in further cooperation with shoulders formed on the nozzle and body which control their rotational relationship. Such control may also occur by the manner in which the body and nozzle are rotated relative to one another during the purging process. Accordingly, devices according to the present invention allow a great degree of flexibility and control in carefully purging gas condensation lines with a minimum of time, effort and expense and with lower risk of damage to the lines.

12 Claims, 1 Drawing Sheet

CONDENSATION LINE PURGING DEVICE

This invention relates to devices for purging condensation lines such as in HVAC systems.

BACKGROUND OF THE INVENTION

HVAC system condensation lines often contain algae, fungus or other foreign matter which can propagate so extensively as to cause obstruction. When that obstruction occurs, the condensation lines typically cause an overflow through their vent lines, which are often located near the HVAC system. This overflow may, if not properly drained, cause flooding of the space in the vicinity of the HVAC system. Such flooding often occurs during the summer months, when HVAC systems are under the greatest load. During these times, HVAC service people are often called upon, on an emergency basis, to purge condensation lines throughout their service areas.

The quintessential technique for purging condensation line is to cut the line, which is typically PVC pipe, and blow, using cheek pressure. This process becomes tiresome after several occasions. Furthermore, the cheek pressure is often insufficient to purge the condensation line, so that other alternative and time consuming measures must be employed. This is frequently difficult if a condensation line is routed through inaccessible portions of the structure.

Other devices have been known for purging blocked pipes. Those include devices having complex structures which are typically employed to unclog plumbing or sewage drains. Complexity is required in part because of the far greater pressures required to unclog such drains, as opposed to the more fragile, typically PVC, HVAC condensation lines for which the present invention is suited. Furthermore, such devices are less concerned with the need to control buildup of pressure within the line carefully in order to avoid breaching places where the line has been spliced, sealed or otherwise contains discontinuities. Such care is required because condensation lines are typically spliced using glue. Such splices may occur in relatively inaccessible portions of the structures threaded by the condensation lines, so that inadvertent breaching could cause considerable follow-on problems.

SUMMARY OF THE INVENTION

The present invention provides devices and assemblies for purging HVAC condensation lines. The devices include a body which features a cavity that is adapted to contain a gas cylinder such as a 12 gram $CO_2$ minicylinder. The walls of the body contain, in the preferred embodiment, a threaded portion. A nozzle forms the second major portion of the devices. The nozzle contains a threaded portion which is adapted to cooperate with the threaded portion on the body. It contains another connection, such as a threaded portion, which connects in turn to a connector which may be attached to the HVAC condensation line. The nozzle contains at least one vent hole and a pin for piercing or penetrating the gas cylinder. In use, the connector may be connected to the condensation line, the nozzle to the connector, and the body threaded to the nozzle.

The body and nozzle preferably contain shoulders which preclude the pin from penetrating the gas cylinders to such an extent that the pin is damaged. Furthermore, the pin is preferably of a shape that allows controlled release of the gas in order to avoid undue buildup in the condensation lines. The shape of the pin may, for instance, be conical. In use, the HVAC technician threads the body onto the nozzle and seats the shoulders of the body and the nozzle against each other. Then, the body is backed off to allow the gas to escape in a controlled manner so as to purge the line without breaching it.

It is therefore an object of the present invention to provide inexpensive, reliable devices for purging condensation lines which effectively purge the lines, but do not breach their seals or rupture them.

It is an additional object of the present invention to provide condensation line purging devices which use conventional gas cylinders.

It is an additional object of the present invention to provide processes for purging condensation lines which present minimal risk of injury to personnel or damage to the lines.

It is an additional object of the present invention to provide condensation line purging devices which allow condensation lines to be purged with minimum time, effort and expense.

Other objects, features and advantages of the present invention will become apparent with respect to the remainder of this document.

DETAILED DESCRIPTION OF THE DRAWINGS

Figure 1:
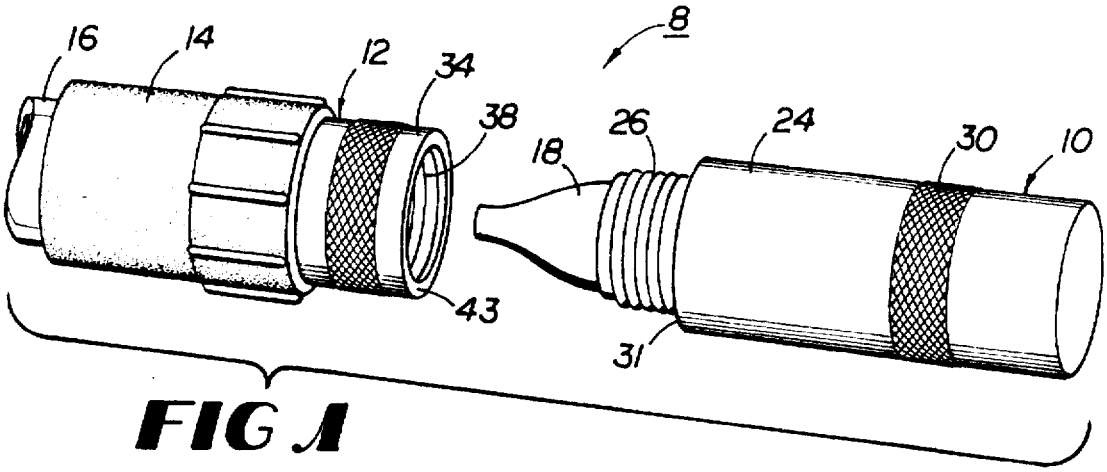
FIG. 1 is a perspective view of a preferred embodiment of devices and assemblies according to the present invention.

FIG. 1 shows condensation line purging device 8 generally comprising a body 10 and a nozzle 12. The nozzle 12 is adapted to fit to a connector 14, which in turn is adapted to connect to a condensation line 16. A gas cylinder 18 fits within a cavity 20 formed within the body 10.

The body 10 may be formed of metal, plastic, or any other desired material. It features inner walls 22 and outer wall 24. The first attachment surface for attaching to the nozzle 12, such as a first threaded surface 26, may be formed on either the inner wall 22 or outer wall 24. In the preferred embodiment, the thread is formed on the outer wall 24. The cavity 20 preferably contains a rounded or beveled portion at the end away from the first threaded surface in order to center the gas cylinder 18 within the cavity 20. This beveled surface is denoted by numeral 28. Body 10 may also contain a knurled surface or other convenient gripping means 30 on outer roll 24.

Figure 2:
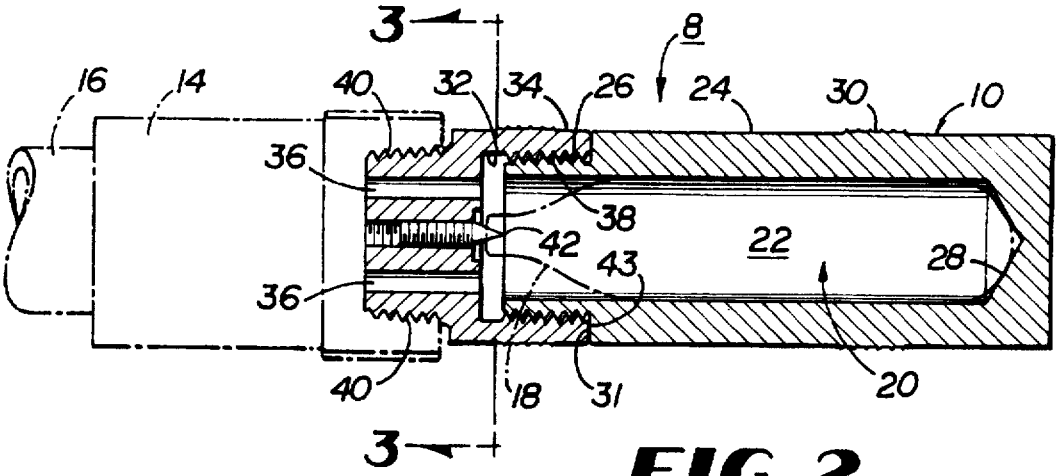
FIG. 2 is a cross-sectional view of the device in FIG. 1.
Figure 3:
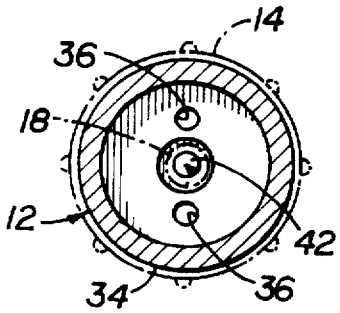
FIG. 3 is a cross-sectional view of the device of FIG. 2, taken across section 3—3 of FIG. 2.
Figure 4:
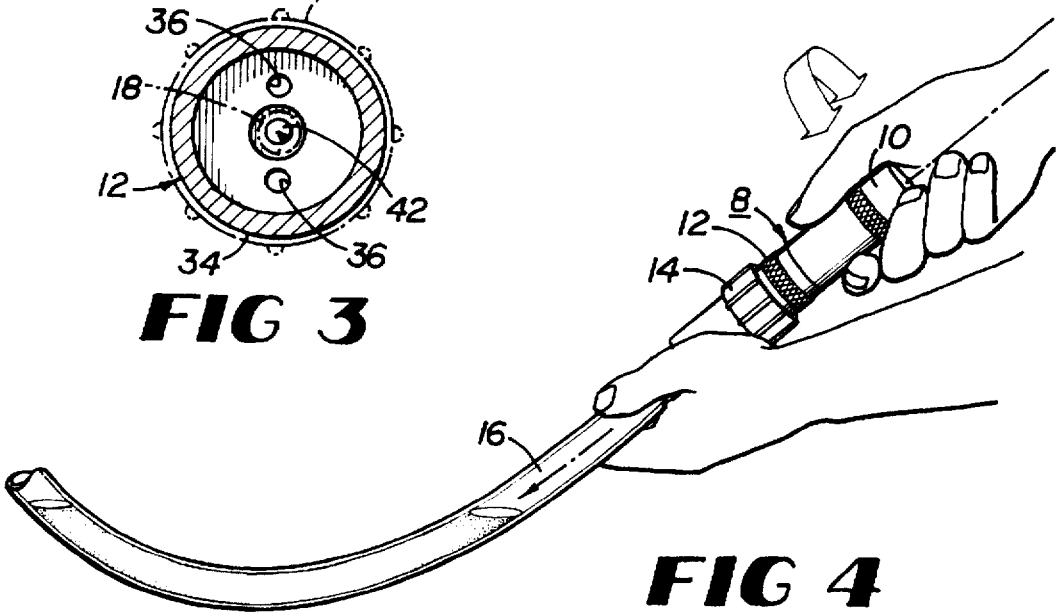
FIG. 4 is a perspective view showing devices and assemblies of the present invention in use.

Nozzle 12 also contains inner walls 32 and outer walls 34. It may be formed of metal, plastic, or any other desired material. In the preferred embodiment, nozzle 12 and body 10 are machined from aluminum. But it is contemplated that they may be formed of suitable plastomeric material. Nozzle 12 may be considered as a cap for the body 10 which generally closes off cavity 20 in a fluid-tight and air-tight relationship, except for one or more vents 36 which may be holes that penetrate the inner wall 32 and outer wall 34 of nozzle 12. Nozzle 12 also contains a first attachment means or threaded surface 38 for cooperating with first threaded surface 26 of body 10. If first threaded surface 26 of body 10 is formed on the outer wall 24 of body 10, then the cooperating first threaded surface 38 of nozzle 12 is formed on inner wall 32 of nozzle 12. This is the case in the preferred embodiment, as shown in FIGS. 1 and 2. As mentioned above, however, the first threaded surfaces may be formed on the other walls, respectively, of body 10 and nozzle 12.

Nozzle 12 also contains a second attachment surface or threaded surface 40 for attaching to a connector 14 which in turn may be connected to the condensation line 16. In the preferred embodiment shown in FIGS. 1 and 2, second surface is a threaded surface, although that need not be the case. The second surface also may be formed on an interior surface in order to cooperate with PVC pipe which is threaded on its outer surface, although that structure is not shown in the drawings.

A pin 42 is featured protruding from the inner wall 32 of nozzle 12. The pin may be formed integrally with nozzle 12, or it may be threaded or otherwise placed in nozzle 12 as shown in FIG. 2. Pin 42 may be of substantially constant cross section, or it may be conical or otherwise formed of substantially non-uniform cross section as shown in FIG. 2.

Operating in conjunction with pin 42 are shoulders 31 of body 10 and 43 of nozzle 12. These shoulders are adapted to butt against one another at a point in time when first threaded surfaces 26 and 38 are cooperating at a predetermined level (or threaded a sufficient amount) to cause pin 42 to penetrate gas cylinder 18, but before pin 42 is damaged, or penetrates gas cylinder 18 too far.

Connector 44 is preferably a standard or stock PVC connector which may be glued or otherwise attached to condensation line 16 and threaded or otherwise attached to second threaded surface 40 of nozzle 12. Gluing to condensation line 16 is preferable, in order to prevent inadvertent explosion of body 10, nozzle 12 and connector 44 away from line 16 and perhaps into the user.

In use, the technician cuts condensation line 16 at a suitable location and then connects connector 44 to the line 16. Then, the technician attaches nozzle 12 to connector 44, as by threading, to form a substantially airtight relationship. The body, which contains a gas cylinder 18, may then be threaded onto nozzle 12. When this relationship has been established, the technician then threads body 10 onto nozzle 12 in a controlled manner so as to release gas from cylinder 18 through vents 36 and connector 44 into condensation line 16. The controlled release of the gas is intended to build pressure in condensation line 16 without causing over pressure that would breach seals or other discontinuities in the line. This control may be a function of the pin shape and its cooperation with the gas cylinder as penetration occurs. It may be a function of such pin configuration in cooperation with shoulders 31 and 43 of body 10 and nozzle 12, respectively. It may also be a function of those structural features with the manner in which body 10 is rotated onto and off of nozzle 12. For instance, one preferred method of use, with the structure shown in FIGS. 1 and 2, is to rotate body 10 onto nozzle 12 fully until shoulders 31 and 43 are seated. Then, the body 10 is backed off so that the varying cross section of pin 42 partially obstructs the penetration formed in gas cylinder 18 as desired to control pressure buildup. Body 10 may be turned on nozzle 12 as desired to control the size of the obstructed opening of gas cylinder 18 and thus the rate of pressure buildup.

When the line has been purged, the nozzle 12 may be disconnected from the connector 14. The connector 14 may be cut from line 16. Both ends of line 16 formed by the cutting may then be spliced to one another using a conventional PVC connector.

The foregoing has been provided for purposes of illustration of a preferred embodiment of the present invention. Modifications, deletions, additions and other changes may be employed without departing from the scope or spirit of the invention.

What is claimed is:

1. A device for purging condensation lines, comprising:

a. a body comprising inner and outer walls forming a cavity adapted to contain at least one gas cylinder and which contains a first threaded surface adapted to receive and cooperate with a nozzle; and b. a nozzle, comprising inner and outer walls, a first threaded surface adapted to receive and correspond to the first threaded surface on the body in a substantially airtight manner; a second threaded surface adapted to receive and correspond to a threaded connector which is in turn adapted to be connected to a condensation line; at least one vent for venting from the cavity of the body to the condensation line; and a pin adapted to penetrate a portion of the gas cylinder in order to release gas from the cylinder in a controlled manner through the vent thereby to purge the condensation line by causing a controlled buildup of pressure in the line which effectively purges the line but does not breach seals or other discontinuities formed in the line.

2. A device according to claim 1 in which the first threaded surface of the body is formed on the outer wall of the body, and the first threaded surface of the nozzle is formed on the inner wall of the nozzle.

3. A device according to claim 1 in which the second threaded surface of the nozzle is formed on the outer wall of the nozzle.

4. A device according to claim 1 in which the pin is adapted to penetrate a portion of the gas cylinder at a point in time when the first threaded surfaces have reached a predetermined level of cooperation.

5. A device according to claim 1 in which the body and the nozzle are formed of metal.

6. A device according to claim 1 in which each of the nozzle and the body contains a shoulder for limiting rotation of the body with respect to the nozzle and the shoulders and the pin are adapted to assist regulation of the rate of discharge of gas through the vent.

7. A device according to claim 1 in which the pin is screwed into the nozzle.

8. A device according to claim 1 in which the pin is formed integrally with the nozzle.

9. A device according to claim 1 in which the pin is of substantially non-constant cross section.

10. A device according to claim 1 in which the pin is substantially conical in shape.

11. An assembly for purging a condensation line, comprising:

a. a body comprising inner and outer walls forming a cavity adapted to contain at least one gas cylinder and which contains a first threaded surface formed on the outer wall and adapted to receive and cooperate with a nozzle;

b. a nozzle, comprising inner and outer walls, a first threaded surface formed on the inner wall and adapted to receive and correspond with the first threaded surface on the body in a substantially airtight manner; a second threaded surface formed on the outer wall and adapted to receive and correspond to a threaded connector which is in turn adapted to be connected to a condensation line; at least one vent for venting from the cavity of the body to the condensation line; and a pin of substantially non-constant cross section adapted to penetrate a portion of the gas cylinder in order to release gas from the cylinder in a controlled manner through the vent thereby to purge the condensation line at a point in time when the first threaded surface of the body and the nozzle have reached a predetermined level of cooperation, but to purge the condensation line without subjecting it to undue pressure which could breach seals or other discontinuities in the condensation line;

c. a gas cylinder contained in the body; and d. a connector comprising inner and outer walls, a threaded surface on the inner wall cooperating with the second threaded surface of the nozzle for attachment in a substantially airtight manner, which connector is attached to the condensation line in a substantially airtight manner; and e. in which the body and the nozzle further comprise shoulders which are adapted to mate at a point in time when the first threaded surfaces of the body and the nozzle have reached a predetermined level of cooperation, and before the pin has penetrated the gas cylinder by a predetermined amount, in order to prevent damage to the pin and/or to control rate of discharge of gas from the cylinder.

12. An assembly according to claim 11 in which the connector is attached to the condensation line using a sealant.

* * * * *